US005413066A

United States Patent [19]

Spencer, Jr. et al.

[11] Patent Number: 5,413,066

[45] Date of Patent: May 9, 1995

[54] POND BOAT

[75] Inventors: William R. Spencer, Jr., Santa Rosa Beach, Fla.; Rodney L. Bridges, Norcross, Ga.

[73] Assignee: Wotter Cycle, Inc., Santa Rosa Beach, Fla.

[21] Appl. No.: 252,771

[22] Filed: Jun. 2, 1994

Related U.S. Application Data

[63] Continuation-in-part of Ser. No. 104,915, Aug. 12, 1993, abandoned.

[51] Int. Cl.[6] ..... B63B 7/00

[52] U.S. Cl. ..... 114/354; 440/27; 440/6

[58] Field of Search ..... 440/3, 56, 6, 28, 31, 440/27, 21, 26; 114/61, 352–354, 345, 362

[56] References Cited

U.S. PATENT DOCUMENTS

| | | | |
|---|---|---|---|
| 3,143,992 | 8/1964 | Beams | 440/29 |
| 3,473,502 | 10/1969 | Wittkamp | 114/61 |
| 4,676,755 | 6/1987 | Yagan | 440/28 |
| 4,698,034 | 10/1987 | Anthonijsz | 440/31 |
| 5,217,398 | 6/1993 | Meron et al. | 440/26 |

FOREIGN PATENT DOCUMENTS

| | | | |
|---|---|---|---|
| 902023 | 4/1945 | France | 440/26 |

*Primary Examiner*—Edwin L. Swinehart

*Attorney, Agent, or Firm*—Harness, Dickey & Pierce

[57] ABSTRACT

A light weight and portable pond boat. The boat includes a frame designed to be flexible and readily disassembled. The frame is supported on a pair of inflatable pontoons and can be positioned along their length, without requiring deflation, to adjust the trim of the boat. A propulsion mechanism is removably mounted to the frame and includes a set of pedals which drive a propeller. The angle at which the propulsion mechanism is carried by the frame is also adjustable to vary the boat's draw requirements. The propulsion mechanism includes a mechanism that enables it to "kick-up" when a submerged object is contacted, lessening damage to the propeller. A steering mechanism and an adjustable seat are also removably mounted to the frame. With all of its components being detachable, capable of being disassembled or deflated, the boat can be packed within a motor vehicle enhancing transportation and storage.

4 Claims, 5 Drawing Sheets

POND BOAT

CROSS REFERENCE TO RELATED APPLICATION

This application is a Continuation-In-Part of U.S. application Ser. No. 08/104,915, filed Aug. 12, 1993 and entitled Pond Boat, now abandoned.

BACKGROUND AND SUMMARY OF THE INVENTION

This invention generally relates to small watercrafts principally used for recreational and fishing purposes. More specifically, the watercraft of this invention relates to a personal boat of the pontoon variety which can be readily assembled at the site of use and disassembled for easy transporting within the trunk of an automobile.

Personal watercrafts having a one or two person seating capacity, hereinafter generally referred to as boats, are increasingly becoming popular for not only well known leisure activities, such as fishing and recreational boating, and also as an alternative form of exercise. In recent years, the market for these personal boats has increased and, in response thereto, so has the variety of personal boats available. While some of these boats have general appeal, others are specialized versions targeted at specific activity markets including fishing, exercise and adventure travel.

In the general leisure activities market, personal boats typically have been provided with a hard exterior shell or hull having a flat, V-shaped or catamaran construction. When compared to traditional boats, the personal boats have been manufactured on a reduced scale so as to enable them to be transported on top of a vehicle, in a pick-up truck bed or on a small trailer. Transoms for mounting small gasoline engines or electric trolling motors, as well as hardware for the use of oars or paddle wheels, have been provided to power the boats. Personal boats targeted for the exercise/adventure market typically are of the single shell design as used in kayaking and the sculls used in the sport of crew. More recent designs, however, have incorporated a pair of hard shells or sculls in a variation of the catamaran. The variants power the boat by oars or a paddle wheel connected by a continuous chain to a set of pedals. Some more recent innovations have included the substitution of a propeller in place of the paddle wheel and enclosing the chain drive system within a housing for increased durability.

While the various boats have to one degree or another worked well in terms of their operation on the water, one lingering problem with these prior designs is that they are not easily transported by an individual to the site of use because they do not "breakdown". If they are of the "breakdown" variety, the hulls and other components still require a relatively large amount of storage space. The difficulty in transporting one of these boats arises from both the weight of the boat and the awkwardness with which the boat or its components are manipulated onto or off of the transporting vehicle or having to utilize a trailer.

For the above reasons, personal boat manufacturers have long desired to produce a boat which is not only lightweight and easily transported, but which also requires a minimum amount of storage space when not in use. Additionally, the boat should contain other qualities which will make the personal boat more popular.

Namely, the boat must be inexpensive, stable, durable, nimble, small in overall size, compact when disassembled and adapted for human powering.

With the above limitations and desires in mind, it is an object of the present invention to provide a personal boat which overcomes the disadvantages of the prior art while meeting the needs of the personal boating consumer and manufacturer. In particular, it is an object of this invention to provide for a personal boat which is light enough in weight to be carried by a single person. A related object of the invention is that the boat must be easy to manipulate so that an individual can readily transport it with a variety of vehicles.

In making the boat easy to load and transport, another object of this invention has been to provide a boat which requires a minimum amount of space for transporting and storage. To this end, it has been yet another object of this invention to provide a "packable" watercraft. As used herein, the term "packable" is intended to mean that the boat can be stored and transported in a disassembled condition, readily assembled at the water's edge prior to use and readily disassembled after use for further transporting or storage of the boat. When disassembled, it is an object of the invention for the boat to fit within the trunk of an automobile.

Another object of the present invention is to provide a personal boat which is extremely stable, highly durable, very nimble yet small in overall size during use.

A further object is to provide a personal boat which is inexpensive to produce and maintain and which can be manually powered by one or more individuals riding within the boat. While not specifically intended to operate as an exercise apparatus, the personal boat of the present invention, when powered manually, would provide a marked degree of physical exercise to the individual or individuals. By manually powering the boat, it is another object of this invention to provide the boat with a propulsion mechanism which is quiet, dependable and has no service requirements. By making the boat quiet, nimble, and easily transportable, the present invention will have particular utility for fishing on small impoundments or ponds that are generally otherwise inaccessible to boats.

In achieving the above and other objects, the personal boat of the present invention is a lightweight packable boat whose features are all designed to enable the boat to be readily assembled and disassembled at the site of use. In achieving its small size, lightweight and packability, the boat of the present invention includes a pair of spaced apart inflatable pontoons. The pontoons provide a high degree of stability to the boat and are maintained apart by a lightweight frame that is removably mounted to the pontoons. The frame itself is constructed from metal rails broken down into three sections enabling easy assembly and disassembly. A detachable seat is mounted to the frame, generally between the pontoons in a position which will allow the user of the boat to operate both the propulsion and steering mechanisms.

The propulsion mechanism is a self-contained unit having a propeller that is shaft driven by a pair of pedals. The propulsion mechanism is removably mounted to the frame at a location between the pontoons and is easily accessed by an individual sitting in the seat. Preferably, the pedals of the propulsion mechanism are mounted toward the front of the boat and the propeller is located rearwardly thereof, generally below the boat's occupant.

The steering mechanism is also removably mounted to the frame and includes a handle positioned adjacent to the seat. The handle enables direct manipulation of a rudder located between the pontoons generally at the rear of the boat. Preferably, the steering mechanism requires only one hand for operation leaving the other hand of the boat's occupant free. The combination of the boat's lightweight, inflatable pontoons, breakdown frame, manually operated propeller and rudder make the boat easily transportable and easy to use.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE PREFERRED EMBODIMENT

Figure 1:
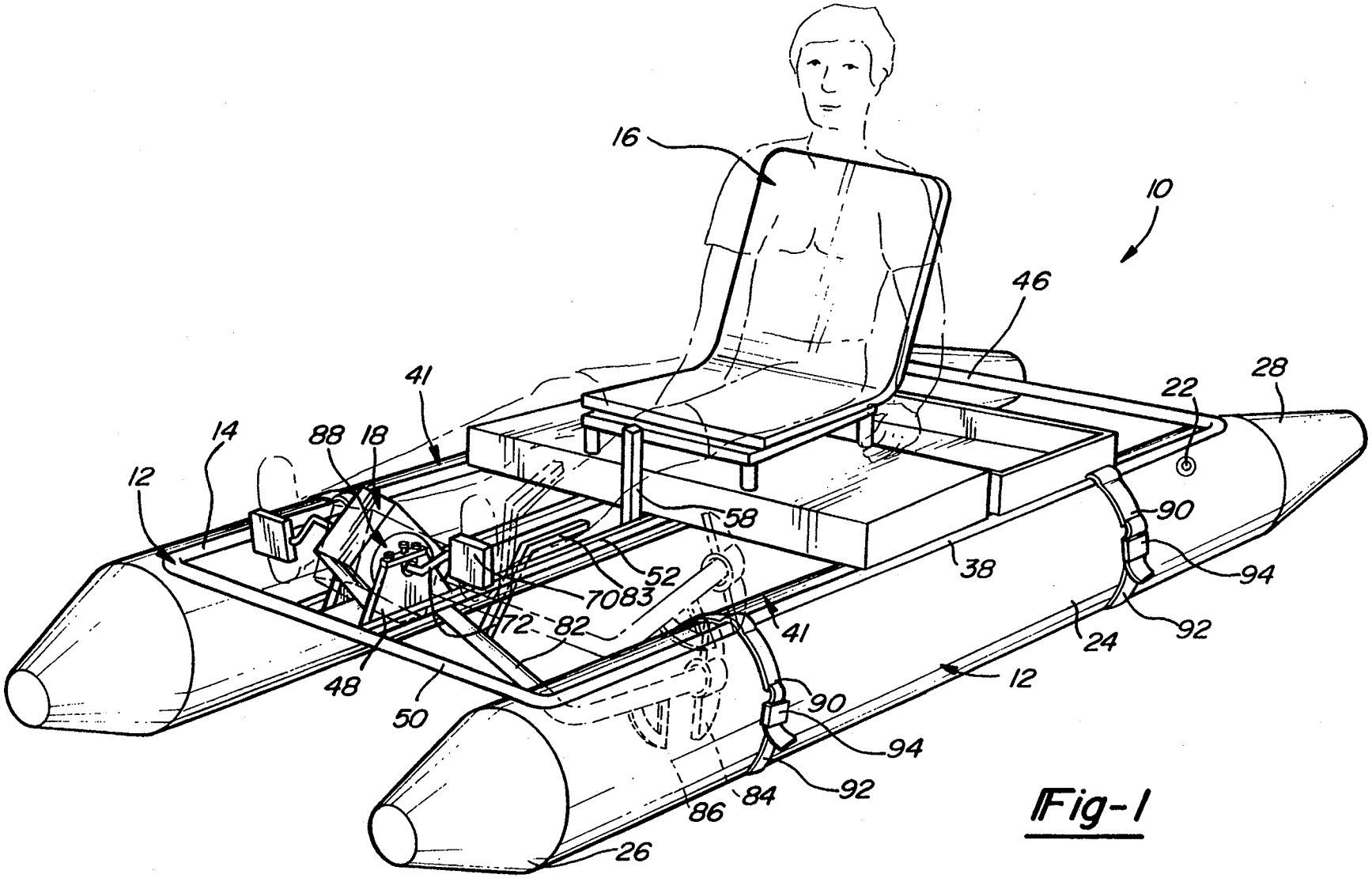
FIG. 1 is a perspective view of a personal boat incorporating the principles of the present invention.

Referring now to the drawing, a personal watercraft or pond boat (hereinafter boat) incorporating the principles of the present invention is illustrated in FIG. 1 and generally designated at 10. The principal components of the boat 10 are a pair of inflatable pontoons 12, a frame 14, a seat 16, a drive mechanism 18 and a steering mechanism 20. As will become apparent from the discussion which follows, the various features of the boat 10 make it lightweight and packable while also providing it with a high degree of stability, durability and mobility.

The pontoons 12 are constructed from a heavy gauge rubber or other suitable material and have an elongated, substantially cylindrical body 24 with a tapered or conical nose 26 and tail 28. Being inflatable, the pontoons 12 are provided with valves 22 that enable them to be inflated through a number of methods including, but not limited to, the use of a portable compressor, a manually operable pump or direct inflation by the user of the boat 10. Preferably, the pontoons 12 are about nine (9) feet in length.

The frame 14, which operates to maintain the pontoons 12 spaced apart from one another, is mounted to and supported by the pontoons 12. The frame 14 is generally constructed out of a number of aluminum rails. While aluminum is the preferred material because of its lightweight and its low cost, alternative lightweight materials could also be used. Several of the rails in the frame 14 have sub-rails which can be disconnected from each other thereby assisting in making the boat 10 packable and transportable within a vehicle, including the trunk of a vehicle.

Figure 2:
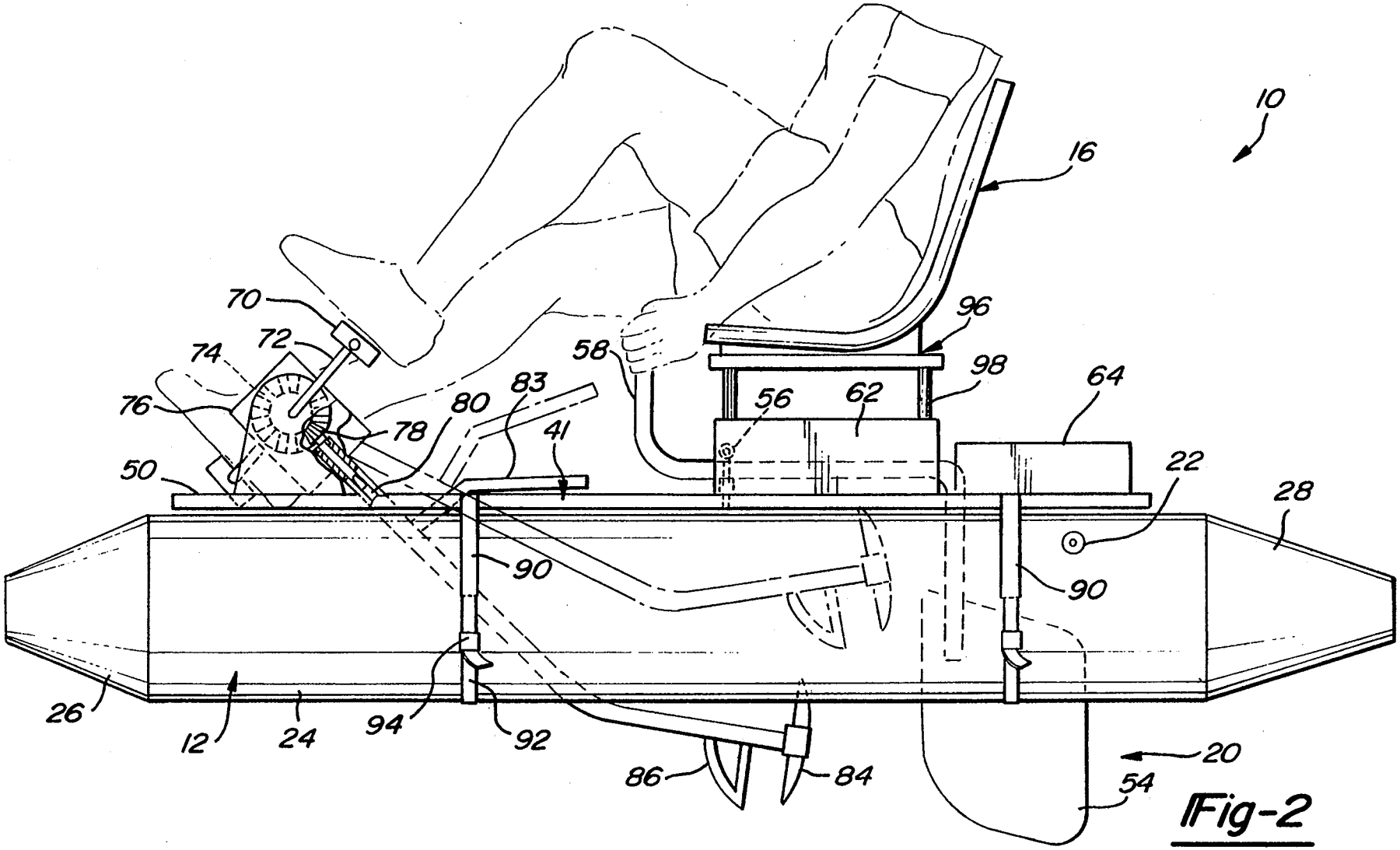
FIG. 2 is a side elevational view of the boat illustrated in FIG. 1 with portions broken away showing the drive mechanism utilized therein.
Figure 3:
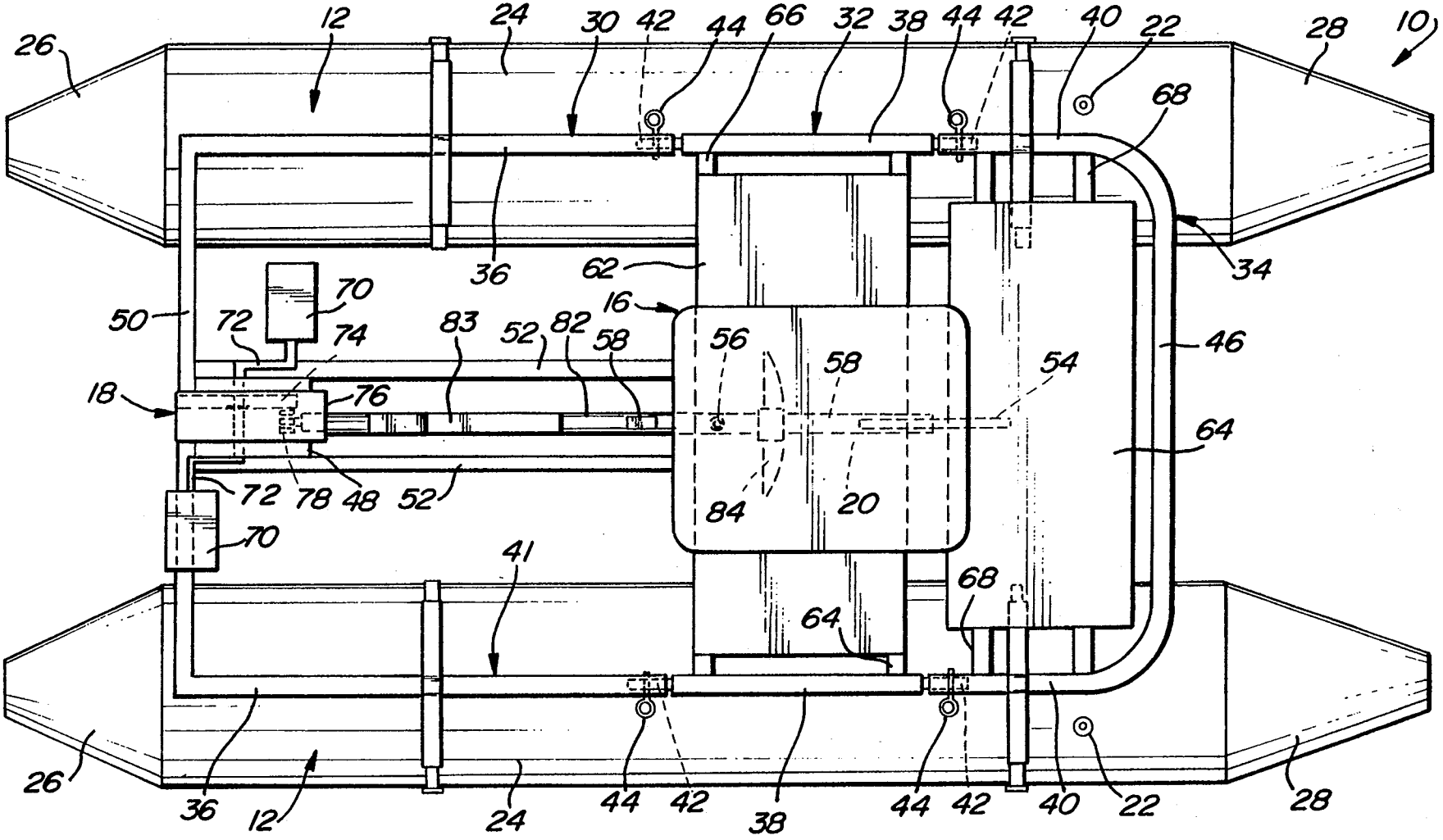
FIG. 3 is a top plan view of a boat incorporating the principles of the present invention.

As best seen in FIG. 3, generally, the frame 14 is divided into three sub-sections, a front section 30, a middle section 32 and a rear section 34. Each of the sections 30, 32 and 34 of the frame 14 includes a pair of opposing longitudinal rails (respectively designated as rails 36, 38 and 40) which are capable of being interconnected with the longitudinal rails of the adjacent section so as to define side rails 41 of the frame 14. While alternative methods can be used to connect the longitudinal rails 36, 38 or 40 of one section 30, 32 or 34 to the longitudinal rails of another section, in the illustrated embodiment the longitudinal rails 38 of the middle section 32 are provided with reduced diameter ends 42 that are received in the interior ends of the longitudinal rails 36 and 40 of the front and rear sections 30 and 34. The longitudinal rails 36, 38 and 40 are provided with apertures which, when properly aligned with one another, receive pins 44 that secure the rails 30, 32 and 34 together. For the sake of clarity, the individual longitudinal rails 36, 38 and 40 (as well as the reduced diameter ends 42 and the pins 44) are only illustrated in FIG. 3 and are omitted from FIGS. 1 and 2 in which the designation of side rail 41 is used.

Figure 4:
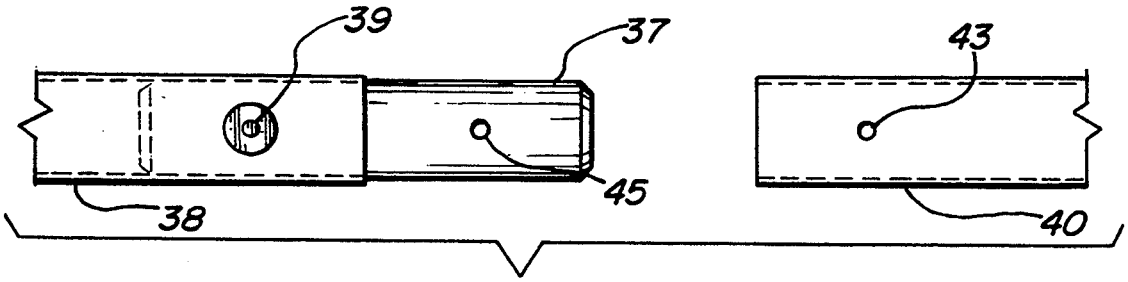
FIG. 4 is a perspective view of the connecting block used in the present invention to secure one section of the frame to another section of the frame while providing for flexing of the sections relative to one another.

Additionally, the longitudinally rails 36, 38, and 40 can be secured to one another through the use of a connecting block or rod 37 as seen in FIG. 4. One end of the connecting block 37 is securely held in the middle longitudinal rail 38 by a rivet or other fastener 39. The opposite end of the connecting block 37 is inserted into the adjacently corresponding rail 36 or 40 and secured by a quick release pin 44 inserted through an aperture 43 in the rail 40 and an aperture 45 in the connecting block 37. The connecting block is constructed from a flexible yet strong material, preferably plastic and more preferably ultra high density polyethylene.

By utilizing the connecting blocks 37 as described above, the frame 14 of the boat 10 is provided with a sufficient amount of "give" and flexibility. In other words, relative flexing between the subsections 30, 32 and 34 can occur. This flexibility enables the boat to readily withstand the forces applied to it as a result of its occupant, the gear loaded on the boat, and the operating conditions of the water.

At the rear of the boat 10, the longitudinal rails 40 of the rear section 34 are connected to each other by an end rail 46 integrally formed therewith. At the front of the boat 10, the longitudinal rails 36 of the front section 30 are integrally connected by a front rail 50 which extends transversely from the forward ends of each longitudinal rail 36, between the pontoons 12. Near the centerline of the boat 10, the front rail 50 has attached to it a pair of rearwardly directed mounting rails 52, between which the drive mechanism 18 is mounted.

The middle section 32 and the rear section 34 are each provided with one or more trays or storage compartments 62 and 64 which extend transversely between the longitudinal rails 38 and 40. The trays 62 and 64 are supported between the longitudinal rails 38 and 40 by support rails, respectively designated as 66 and 68, which are welded or otherwise secured between the longitudinal rails 38 and 40. The trays 62 and 64 are constructed from plastic or another lightweight material and provide ample amounts of storage areas which can be easily accessed from the seat 16 for various items such as fishing poles, tackle boxes, coolers and miscellaneous personal items.

One or more seats 16 are supported by a fore and aft adjustment mechanism 96, of a known variety, secured on a riser 98 mounted to the transverse support rail 66. The riser 98 is removable from the frame 14 and can be provided with a known mechanism to raise or lower the sitting position of the individual using the boat 10.

The steering mechanism 20 includes a rudder 54 which is pivotally mounted at 56 to one of the transversely extending support rails 66. The rudder 54 may be manipulated through a variety of steering control mechanisms known within the industry. In the present invention, the rudder 54 operates in response to the movement of a handle 58 about the pivot 56. The steering mechanism 20 is detachable from frame 14 for packing purposes and, as such, utilizes a disengageable pin or other fastener at the pivotable mounting 56. Since such steering mechanisms 20 are well known in the industry, further details are not set out herein.

As mentioned above, the drive mechanism 18 is removably mounted to a bracket 48 extending up from between the mounting rails 52 at the front of the boat 10. The specific drive mechanism 18 utilized in the present invention includes a set of pedals 70 mounted on crank arms 72 which extend generally between the bracket 48, the mounting rails 52 and through a housing 76 which encloses a set of gears. One of the gears, a transverse bevel gear 74, is supported for coaxial rotation with the crank arms 72 and engages an axial bevel gear 78. The axial bevel gear 78 is coupled to cause rotation of a flexible drive shaft or cable 80 which is supported by a bushing and extends from the housing 76 through a downwardly and rearwardly directed hollow shaft 82. The drive shaft 80 floats within the hollow shaft 82 and is supported in square broached holes at the ends of the hollow shafts 82. At the opposing end of the hollow shaft 82, generally beneath the seat 16, the drive cable 80 terminates in a propeller 84 mounted to rotate with the drive cable 80 in response to rotation of the pedals 70 and the crank arms 72. The hollow shaft 82 is permanently lubricated and provided with seals (not shown) at both of its ends to eliminate periodic servicing of the drive cable 80.

A propeller guard 86 is mounted on the hollow shaft 82 generally before or in front of and below the propeller 84. The guard 86 prevents the propeller 84 from hitting submerged objects such as stumps, rocks, logs or becoming entangled in weeds.

As mentioned above, the drive mechanism 18 is provided so that it can be quickly disengaged from the frame 14 and the mounting rails 52. One method of providing for this disengagement is to form threaded fittings (not shown) on the crank arms 72 that will enable them to separate from each other and pull out of the housing 76 and away from the primary beveled gear 74. As such, the beveled gear 74 may be supported by a bushing and sleeve (not shown) within the housing 76 and be configured so that it will not rotate with the crank arms 72. With the crank arms 72 removed, the housing 76 and the remainder of the drive mechanism 18 can be pulled away from the bracket 48.

Alternatively, instead of using the crank arms 72 to mount the drive mechanism 18 to the bracket 48, the housing 76 could be secured to the mounting rails 52 by attaching the bracket 48 in a well-known quick release method such as by using fasteners which are readily removable from the rails 52. This would eliminate the need to disconnect the crank arms 72 in order to disengage the drive mechanism 18.

Figure 5A:
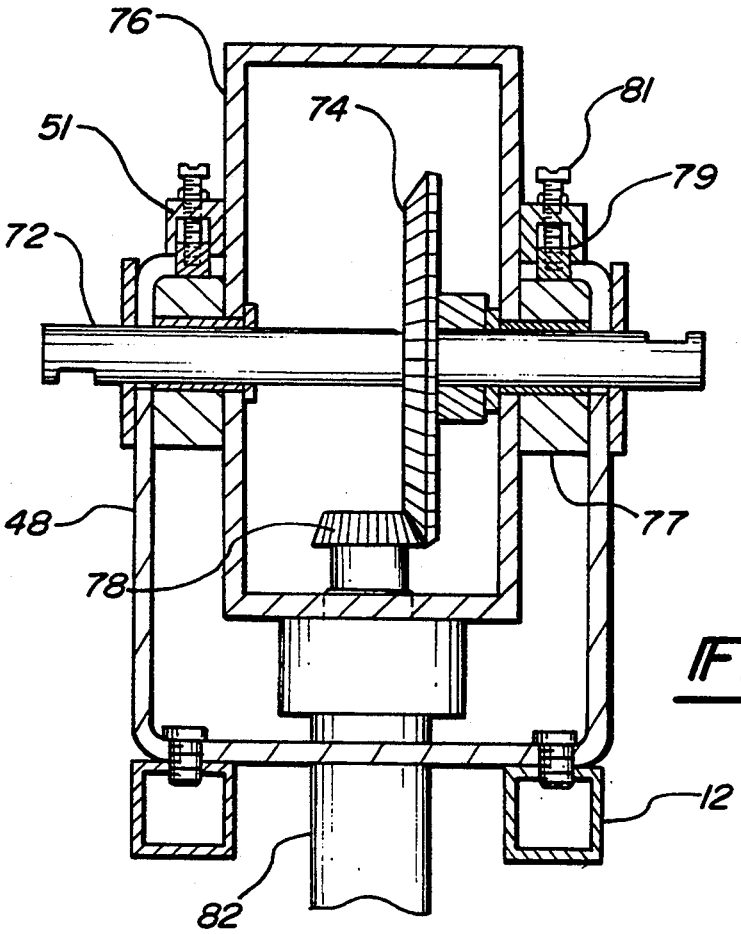
FIG. 5*a* is an end sectional view of a portion of the drive mechanism showing the detachable mounting and the mechanism by which the position and depth of the propeller can be adjusted.

Another alternative for removably mounting the drive mechanism 18 to the frame 14 is to provide the bracket 48 itself with a quick release feature that secures the drive mechanism 18 thereto. This is illustrated in FIGS. 5*a* and *b*. As seen in the figures, the brackets 48 are formed as pillow blocks having saddles 49 into which the crank arms 72 of the drive mechanisms 18 are received. A mounting block 51 is secured by fasteners 53 to the bracket 48 so as to capture the crank arms 72, and therefore the drive mechanism 18, therebetween. Obviously, additional alternatives than those described above could be proposed and those alternatives are therefore deemed to be within the purview of the present invention.

The drive mechanism 18 is further provided so that the depth and angle of the propeller 84 is adjustable and so that the drive mechanism 18 will be allowed to breach or "kick-up" when the propeller guard 86, the propeller 84 or the hollow shaft 82 comes into contact with a submerged object. A common mechanism provides for both adjustment and breaching. Generally designated at 88 in FIG. 1, the mechanism 88 is provided with detents, locking pins, friction plates and/or other known features that enable positioning of the drive mechanism 18 in its up or breached position, in its down or use position, as well as in positions between these two thereby allowing for depth adjustment. The adjustment feature of the breaching mechanism 88 is provided so that a threshold amount of force is necessary to "kick-up" the drive mechanism 18. This prevents inadvertent and unnecessary breaching in response to forces applied on the propeller 84 during normal use of the boat 10 and in response to minor or insignificant contact with submerged objects.

Figure 5B:
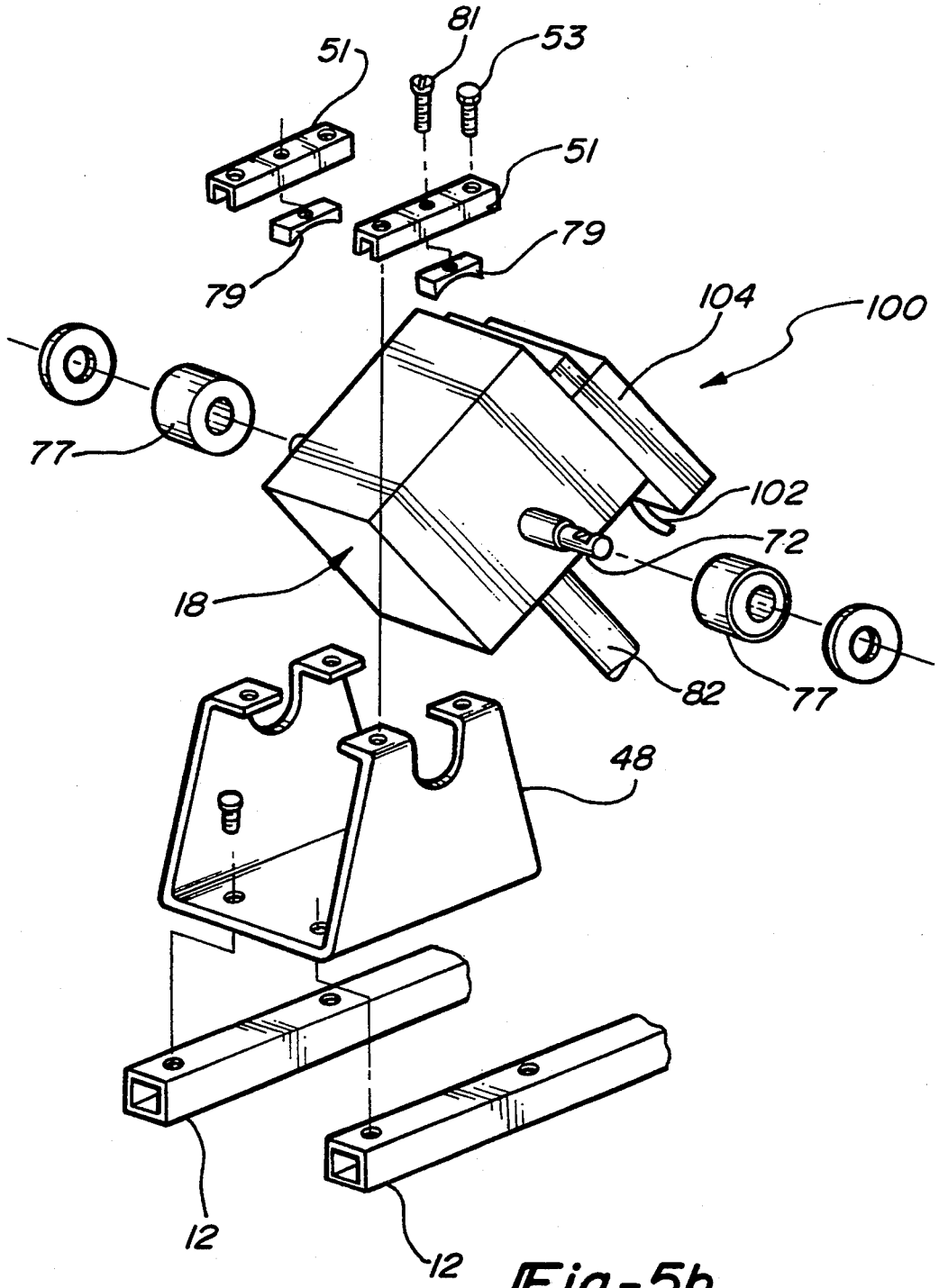
FIG. 5*b* is an exploded side perspective view of the drive mechanism and mounting seen in FIG. 5*a* and further showing a motor assembly attached to the drive mechanism.

An alternative and more preferred mechanism 88 is that shown in FIGS. 5*a* and 5*b*. This mechanism 88 utilizes the mounting block 51 that secures the drive mechanism 18 in the bracket 48. In this preferred embodiment, a pivot bushing 77 is mounted or welded to both sides of the housing 76 of the drive mechanism 18 so that they are positioned between and support the housing 76 in the bracket 48. The pivot bushing 77 is engaged by a nylon friction block 79 which is adjustably secured to the mounting block 51. An adjustment screw 81, extending through the mounting block 51, raises and lowers the friction block 79 thereby adjusting the force of engagement between the block 79 and the bushing 77. Being infinitely adjustable, the friction force occurring between the friction block 79 and bushing 77 can be adjusted to allow for different expected torque applications, such as forward and reverse shifts of the propeller 84 and different propeller 84 sizes, without allowing rotation of the drive mechanism 18 relative to the remainder of the boat 10.

By manipulating and setting the engagement force between the friction block 79 and pivot bushing 77, the depth and angle of the propeller 84 can be adjusted to create the desired drafting of the boat 10. A handle 83 is mounted to the hollow shaft 82 specifically for the purpose of raising or lowering the propeller 84 to the desired level/angle before setting the friction block 79. This handle 83 is best seen in FIGS. 1 and 2.

As mentioned previously, the frame 14 is supported on the pontoons 12 and operates to maintain the pontoons 12 spaced apart from one another. Additionally, the positioning of the frame on the pontoons 12, either fore or aft, operates to adjust the trim of the boat 10 thereby accommodating the weight distribution on the boat 10. While various mechanisms for securing the frame 14 onto the pontoons 12 can be envisioned, three embodiments are presented herein.

When the frame 14 is properly positioned, the side rails 41 will extend generally along the top of the pontoons 12 so that they are directly supported by the pontoons 12. To prevent the side rails 41 from moving or slipping off of the side of the pontoons 12, the side rails 41 are provided with stabilizing frame members or bands 90 which extend transversely from the side rails 41 and at least partially around the circumference of the pontoon's body 24. In the embodiment illustrated in FIG. 1, the stabilizing members 90 are arcuate and extend about half way around the body 24 of the pontoon 12. In this manner, the frame 14 can be freely positioned and held on the pontoons 12 by the interaction of the frame members 90 with the pontoons 12 under the influence of gravity and without additional assistance.

If rough water conditions are anticipated, one end of a tie strap 92 is fitted and secured through an opening in the end of the member 90 and extended the remainder of the way around the pontoon 12 so as to connect the opposing end of the member 90. The tie strap 92 may incorporate a cam or other type of buckle 94 so that it can be easily tightened and readily released from the pontoon 12 without requiring deflation of the pontoon 12. In another embodiment, the members 90 can be omitted and hook and loop fasteners (not shown) provided over the top of the side rails 41 to secure the side rails 41 onto the pontoons.

The mounting arrangements detailed above allow the frame 14 to be adjustably positioned along the length of the pontoons 12 without requiring the pontoons 12 to be deflated prior to adjustment. As a result, the boat 10 of the present invention can be properly trimmed to accommodate the weight distribution over the pontoons 12 by moving the loaded frame 14 fore or aft relative to the pontoons 12. With deflation of the pontoons is not being required, the trimming procedure is simplified and readily accomplished ensuring safe and proper operation of the boat 10 as the load changes.

As seen from the above discussion, the boat 10 of the present invention is constructed so that it can be easily assembled for use and disassembled for transporting and storage. When disassembled, the boat 10 is reduced to seven basic components: the pontoons 12, the three sections of the frame 14, the seat 16, the drive mechanism 18, and the steering mechanism 20. All of these components can then be placed into one or more storage bags and the entire disassembled boat 10 placed in the trunk of an automobile.

Because the several components, as well as the boat 10 itself, are individually light in weight, one person can easily carry and manipulate the boat 10 in either its assembled or disassembled state. The light weight of the boat 10 is achieved by constructing the pontoons 12 from rubber, the frame 14 from welded aluminum, and the drive and steering mechanisms 18 and 20 from aluminum and stainless steel. The seat 16 and trays 62 and 64 are made from other lightweight materials such as plastic. As such, a boat 10 constructed according to the principles of the present invention, having overall dimensions of about nine (9) feet long and four (4) feet wide, weighs approximately forty-five (45) pounds. The compact and durable construction of the drive mechanism 18, which is only about eight pounds itself, significantly contributes to this lightweight.

Since the propeller 84 can be positioned so that it does not churn the surface of the water when the boat 10 is in use, as in boats of the paddle wheel variety, and since the rubber pontoons 12 will glide silently across the water chop and while remaining steady, the boat 10 of this invention is extremely quiet and stable. Furthermore, by positioning the propeller 84 generally in the center of boat 10 with the rudder 54 at the rear of the boat, the boat's maneuverability is enhanced.

If desired, the drive mechanism 18 can be adapted to receive an electric motor attachment 100, as generally seen in FIG. 5*b*, for power assisted propulsion. As such, a battery (not shown) would be mounted to the rear storage or other compartment 64 and a wire lead 102 clipped to the frame 14 extended from the battery to a high torque, electric motor 104. The motor 104 is mounted to the housing 76 with screws 106 such that a gear 108 engages the gear 74 and causes the propeller 84 to rotate. Conventional trolling motor controls are then provided for operating the motor 104.

While the above description constitutes the preferred embodiments of the present invention, it will be appreciated that the invention is susceptible to modification, variation and change without departing from the proper scope and fair meaning of the accompanying claims.

We claim:

1. A pond boat that can be readily assembled and disassembled at the site of use thereby enabling easy transporting of said boat within an automotive vehicle, said boat comprising:

a pair of spaced apart pontoons, each of said pontoons being inflatable and having an elongated shape;

a frame made up of a plurality of axial and transverse rails being supportable by said pontoons, said axial rails extending lengthwise of said pontoons and said transverse rails extending transversely relative to said axial rails, said frame adapted to maintain said pontoons spaced apart from one another and including mounting means for removably mounting said frame to said pontoons, said mounting means having mounting members extending transversely relative to said axial rails and at least partially around said pontoons, a flexible strap secured to opposing ends of each of said mounting members and extending the remaining way around said pontoon, said strap including an adjustment means for tightening said strap to said pontoon and retaining said strap and said frame with said pontoons, said strap thereby securing said frame to said pontoons, said frame further having a plurality of subsections and including a front section and a rear section being removably interconnected to one another;

propulsion means for propelling said boat, said propulsion means including a propeller and drive mechanism having at least one set of manually operable pedals coupled to said propeller by a flexible shaft, rotation of said shaft by said pedals thereby causing rotation of said propeller and propulsion of said boat, said propulsion means being removably mounted to said frame in a pair of brackets;

resistance means for permitting rotation of said propulsion means about an axis upon contact between said propulsion means and a submerged object with a predetermined amount of force, said resistance means including at least one friction block engaging a portion of said propulsion means and providing limited resistance to rotation of said propulsion means about said axis, said resistance means resisting rotation of said propulsion means up to a predetermined load being applied to said propulsion means;

a rudder removably mounted to said frame to steer said boat; and a seat supported by said frame generally between said pontoons in a position allowing an occupant of said boat to operate said propulsion means and said rudder.

2. A pond boat as set forth in claim 1 wherein said resistance means is adjustable to increase or decrease the resistance to rotation.

3. A pond boat that can be readily assembled and disassembled at the site of use thereby enabling easy transporting of said boat within an automotive vehicle, said boat comprising:

a pair of spaced apart pontoons, each of said pontoons being inflatable and having an elongated shape;

a frame made up of a plurality of axial and transverse rails being supportable by said pontoons, said axial rails extending lengthwise of said pontoons and said transverse rails extending transversely relative to said axial rails, said frame adapted to maintain said pontoons spaced apart from one another and including mounting means for removably mounting said frame to said pontoons, said mounting means having mounting members extending transversely relative to said axial rails and at least partially around said pontoons, a flexible strap secured to opposing ends of each of said mounting members and extending the remaining way around said pontoon, said strap including an adjustment means for tightening said strap to said pontoon and retaining said strap and said frame with said pontoons, said strap thereby securing said frame to said pontoons, said frame further having a plurality of subsections and including a front section and a rear section being removably interconnected to one another;

propulsion means for propelling said boat, said propulsion means including a propeller and drive mechanism having at least one set of manually operable pedals coupled to said propeller by a flexible shaft, rotation of said shaft by said pedals thereby causing rotation of said propeller and propulsion of said boat, said propulsion means being removably mounted to said frame in a pair of brackets and being removably mounted to said brackets by pillow blocks defining a journal in which a portion of said propulsion means is seated, said pillow blocks including a mounting plate secured thereto by fasteners so as to capture and retain said portion of said propulsion means within said journal;

a rudder removably mounted to said frame to steer said boat; and a seat supported by said frame generally between said pontoons in a position allowing an occupant of said boat to operate said propulsion means and said rudder.

4. A pond boat that can be readily assembled and disassembled at the site of use thereby enabling easy transporting of said boat within an automotive vehicle, said boat comprising:

a pair of spaced apart pontoons, each of said pontoons being inflatable and having an elongated shape;

a frame made up of a plurality of axial and transverse rails being supportable by said pontoons, said axial rails extending lengthwise of said pontoons and said transverse rails extending transversely relative to said axial rails, said frame adapted to maintain said pontoons spaced apart from one another and including mounting means for removably mounting said frame to said pontoons, said mounting means having mounting members extending transversely relative to said axial rails and at least partially around said pontoons, a flexible strap secured to opposing ends of each of said mounting members and extending the remaining way around said pontoon, said strap including an adjustment means for tightening said strap to said pontoon and retaining said strap and said frame with said pontoons, said strap thereby securing said frame to said pontoons, said frame further having a plurality of subsections and including a front section and a rear section being removably interconnected to one another;

propulsion means for propelling said boat, said propulsion means including a propeller and drive mechanism having at least one set of manually operable pedals coupled to said propeller by a flexible shaft, rotation of said shaft by said pedals thereby causing rotation of said propeller and propulsion of said boat, said propulsion means being removably mounted to said frame in a pair of brackets;

an electric motor coupled to said propulsion means, said electric motor coupled to said flexible shaft and causing rotation of said flexible shaft and said propeller;

a rudder removably mounted to said frame to steer said boat; and a seat supported by said frame generally between said pontoons in a position allowing an occupant of said boat to operate said propulsion means and said rudder.

* * * * *